US008309851B2

(12) United States Patent
Abe et al.

(10) Patent No.: US 8,309,851 B2
(45) Date of Patent: Nov. 13, 2012

(54) INSULATED WIRE AND MANUFACTURING METHOD OF THE SAME

(75) Inventors: Tomiya Abe, Hitachi (JP); Yoshihisa Kato, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 297 days.

(21) Appl. No.: 12/656,407

(22) Filed: Jan. 28, 2010

(65) Prior Publication Data

US 2010/0212928 A1 Aug. 26, 2010

(30) Foreign Application Priority Data

Feb. 24, 2009 (JP) ..... 2009-041051

(51) Int. Cl.
*H01B 3/30* (2006.01)

(52) U.S. Cl. ..... 174/110 R

(58) Field of Classification Search ..... 174/110 R, 174/110 SR, 110 F
See application file for complete search history.

(56) References Cited

U.S. PATENT DOCUMENTS

| | | | | |
|---|---|---|---|---|
| 6,573,305 | B1 * | 6/2003 | Thunhorst et al. | 521/50.5 |
| 2003/0139482 | A1 | 7/2003 | Kadonaga et al. | |
| 2005/0249954 | A1 * | 11/2005 | Kawaguchi et al. | 428/414 |
| 2006/0097361 | A1 | 5/2006 | Tanaka et al. | |

FOREIGN PATENT DOCUMENTS

| | | |
|---|---|---|
| JP | 7-272662 | 10/1995 |
| JP | 7-272663 | 10/1995 |
| JP | 7-278333 | 10/1995 |
| JP | 7-320506 | 12/1995 |
| JP | 7-335053 | 12/1995 |
| JP | 8-17256 | 1/1996 |
| JP | 8-17257 | 1/1996 |
| JP | 9-102230 | 4/1997 |
| JP | 10-36411 | 2/1998 |
| JP | 11-176262 | 7/1999 |
| JP | 11-297142 | 10/1999 |
| JP | 3047686 | 3/2000 |
| JP | 2002-145913 | 5/2002 |
| JP | 2004-2812 | 1/2004 |
| JP | 2004-91569 | 3/2004 |
| JP | 3963765 | 6/2007 |
| JP | 2007-332283 | 12/2007 |
| WO | WO2004/048064 | 6/2004 |

* cited by examiner

*Primary Examiner* — Chau Nguyen
(74) *Attorney, Agent, or Firm* — McGinn IP Law Group, PLLC

(57) ABSTRACT

An insulated wire includes a conductor, and an insulating layer of a porous member formed on the conductor by using a water-in-oil type emulsion (W/O emulsion) including a thermosetting liquid solventless varnish as the oil and water drops of water-soluble polymer contained in the thermosetting liquid solventless varnish as the water. The insulating layer of the porous member is formed by that the water-in-oil type emulsion is coated so as to form a thin film as a coated film, the thermosetting liquid solventless varnish as the oil is polymerized and cured after the formation of the thin film, and the water drops as the water is dried and removed after the curing of the thermosetting liquid solventless varnish.

2 Claims, 1 Drawing Sheet

INSULATED WIRE AND MANUFACTURING METHOD OF THE SAME

The present application is based on Japanese patent application No.2009-041051 filed on Feb. 24, 2009, the entire contents of which are incorporated herein by reference.

BACKGROUND OF THE INVENTION

1. Field of the Invention

This invention relates to an insulated wire and a manufacturing method of the insulated wire. In particular, this invention relates to an insulated wire having an insulating layer of a porous member and a manufacturing method of the insulated wire.

2. Description of the Related Art

In an information-processing device, speed increase in transmission signal has been progressed, so that a wire having a foamed insulation formed by extrusion and foam molding of polyethylene or fluorine resin is used as a wire used for the above-mentioned application, so as to place emphasis on low dielectric permittivity.

Recently, since downsizing and density growth of the device have been furthermore progressed, it has been necessary for the wire to be used to have an external diameter of for example, not more than 0.3 mm. Since it has become technically difficult to fabricate the fine wire by the extrusion and foam molding, a method of fabricating a wire having an foamed member by coating and curing an ultraviolet curable resin containing a gas or a foaming agent is proposed. The method is disclosed in, for example, JP-B-3047686, JP-A-07-278333, JP-A-07-272662, JP-A-07-272663, JP-A-07-335053, JP-A-08-17256, JP-A-08-17257, JP-A-07-320506, JP-A-09-102230, JP-A-11-176262, and JP-A-11-297142.

The method is excellent in forming the foamed insulating layer quickly and efficiently, but they have a process of forming the insulation while growing air bubbles, so that they have a problem that growth level of the air bubbles is not easily controlled and variation in foaming level is easily caused. Further, if the variation in foaming level of the insulation occurs, variation in dielectric permittivity of the insulation occurs and simultaneously variation in transmission characteristics of a wire or a cable occurs, so that a problem is caused that signal transmission delay is generated.

Consequently, a method of forming fine foams is proposed. The method is disclosed in, for example, JP-A-2004-2812, JP-B-3963765, and WO2004/048064(pamphlet).

According to the method, the formation of the fine foams is capable of preventing the variation in foaming level of the insulation from occurring.

However, the method disclosed in JP-A-2004-2812 can not be used as an insulator of a wire or a cable, since it has a process of forming fine air bubbles by using a polymer containing a compound degradable with an acid generated by light irradiation and the acid generated erodes a metallic conductor.

Also, the method disclosed in JP-B-3963765 and WO2004/048064(pamphlet) has a problem that plenty of fabricating time is required, so that it is difficult to be used for fabricating a wire or a cable.

Further, a method of fabricating a porous member by using an emulsion is proposed. The method is disclosed in, for example, JP-A-10-36411, JP-A-2004-91569, JP-A-2007-332283, and JP-A-2002-145913. However, the method disclosed in the patent literatures has a problem that it is difficult to be used for a cover of a wire or a cable and simultaneously electrostatic capacitance of the wire varies due to mechanical force, since air bubbles obtained have an interconnected cell structure (mutually combined structure) and collapse deformation is easily caused due to stress such as compression stress, bending stress.

SUMMARY OF THE INVENTION

Therefore, it is an object of the invention to provide an insulated wire having an insulating layer of a porous member that variation of foaming level (rate of air bubbles and resin) of the insulation is prevented, the foaming level is high, and the foaming state is uniform even in case of the thin insulating layer, and the insulated wire is remarkably high in productivity. It is a further object of the invention to provide a manufacturing method of the insulated wire.

(1) According to one embodiment of the invention, an insulated wire comprises:

a conductor; and an insulating layer of a porous member formed on the conductor by using a water-in-oil type emulsion (herein referred to as "W/O emulsion") comprising a thermosetting liquid solventless varnish as the oil and water drops of water-soluble polymer contained in the thermosetting liquid solventless varnish as the water, wherein the insulating layer of the porous member is formed by that the water-in-oil type emulsion is coated so as to form a thin film as a coated film, the thermosetting liquid solventless varnish as the oil is polymerized and cured after the formation of the thin film, and the water drops as the water is dried and removed after the curing of the thermosetting liquid solventless varnish.

In the above embodiment (1), the following modifications and changes can be made.

(i) The thermosetting liquid solventless varnish as the oil comprises an ultraviolet cure resin precursor, and the precursor is polymerized and cured by ultraviolet irradiation.

(ii) The water-soluble polymer comprises one selected from an alkyl cellulose compound, polyvinyl alcohol, polyethylene glycol, and polypropylene glycol.

(2) According to another embodiment of the invention, a method of fabricating an insulated wire comprising a conductor and an insulating layer of a porous member formed on the conductor comprises:

providing a water-in-oil type emulsion (W/O emulsion) comprising a thermosetting liquid solventless varnish as the oil and water drops of water-soluble polymer contained in the thermosetting liquid solventless varnish as the water;

forming the insulating layer of the porous member by coating the water-in-oil type emulsion so as to form a thin film as a coated film;

polymerizing and curing the thermosetting liquid solventless varnish as the oil after the formation of the thin film; and drying and removing the water drops as the water after the curing of the thermosetting liquid solventless varnish.

In the above embodiment (2), the following modifications and changes can be made.

(iii) The thermosetting liquid solventless varnish as the oil comprises an ultraviolet cure resin precursor, and the precursor is polymerized and cured by ultraviolet irradiation.

(iv) The water-soluble polymer comprises one selected from an alkyl cellulose compound, polyvinyl alcohol, polyethylene glycol, and polypropylene glycol.

Advantages of the Invention

According to one embodiment of the invention, an insulated wire can be provided with an insulating layer of a porous member that the foaming level is high and the foaming state is uniform even in case of the thin insulating layer, and the insulated wire is remarkably high in productivity and industrially useful.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Figure 1:
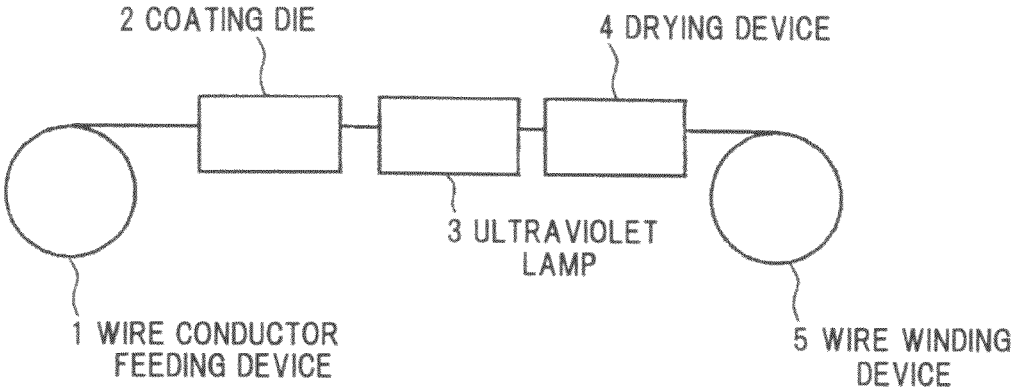
FIG. 1 is an explanatory view schematically showing a coating-curing-drying machine for fabricating an insulated wire having an insulating layer of a porous member according to one embodiment of the invention.

The preferred embodiment according to the invention will be explained below referring to the drawings.

An insulated wire according to the embodiment includes a conductor and an insulating layer of a porous member formed on the conductor by using a water-in-oil type emulsion (W/O emulsion) having a thermosetting liquid solventless varnish as the oil and water drops of water-soluble polymer contained in the thermosetting liquid solventless varnish as the water, wherein the insulating layer of the porous member is formed by that the water-in-oil type emulsion is coated so as to form a thin film as a coated film; the thermosetting liquid solventless varnish as the oil is polymerized and cured after the formation of the thin film; and the water drops as the water is dried and removed after the curing of the thermosetting liquid solventless varnish.

The thermosetting liquid solventless varnish as the oil is preferably formed of an ultraviolet cure resin precursor, and is preferably polymerized and cured by ultraviolet irradiation.

The water-soluble polymer is preferably alkyl cellulose compound, polyvinyl alcohol, polyethylene glycol, or polypropylene glycol.

The thermosetting liquid solventless varnish as the oil has preferably a basic structure that contains a polymerizable oligomer, a polymerizable monomer and a cross-linking initiator.

Here, the polymerizable oligomer means a compound having not less than two of functional groups having an unsaturated bond such as an acryloyl group, a methacryloyl group, an acrylic group, and a vinyl group. A polymerizable oligomer in which a part of elements is substituted by fluorine can be also used.

The polymerizable oligomer includes epoxy acrylate oligomer, epoxidized oil acrylate oligomer, urethane acrylate oligomer, polyester urethane acrylate oligomer, polyether urethane acrylate oligomer, polyester acrylate oligomer, polyester acrylate oligomer, vinyl acrylate oligomer, silicone acrylate oligomer, polybutadiene acrylate oligomer, polystyrene ethyl methacrylate oligomer, polycarbonate dicarbonate oligomer, unsaturated polyester oligomer, polyene/thiol oligomer and the like.

The polymerizable oligomer is usable either alone or as a blended composition.

In the embodiment, the polymerizable monomer means a compound having not less than two of an acryloyl group, a methacryloyl group, an acrylic group, a vinyl group and the like.

In the embodiment, the cross-linking initiator means an agent that is degradable by light irradiation so as to generate free radicals having a function that initiates curing of the polymerizable oligomer and the polymerizable monomer. The cross-linking initiator includes benzoin ether compound, ketal compound, acetophenone compound, benzophenone compound and the like.

The water-soluble polymer in the embodiment means a polymer that has a function of enhancing stability of an emulsion by being dissolved in water so as to increase viscosity of the water, and if water-soluble, it is not particularly limited. For example, it includes a water-soluble cellulose compound such as hydroxymethylcellulose, hydroxyethylcellulose, hydroxypropylcellulose; polyvinyl alcohol; polyethyleneglycol; polypropyleneglycol and the like.

Method of Fabricating Emulsion

The method of fabricating the W/O emulsion in the embodiment includes an agitation-emulsifying method of agitating a composition containing a UV-curing resin prepolymer and a water-soluble polymer mixed in water and lubricant by a high speed agitating machine so as to emulsify it, an ultrasonic sound wave-emulsifying method of emulsifying the composition by using an emulsifying device based on ultrasonic sound wave, and a membrane-emulsifying method of passing the composition through a porous membrane such as a glass filter, and the method is not particularly limited.

In the embodiment, the compounds described below can be appropriately blended in the W/O emulsion, if needed. Namely, the compounds include an initiator assistant, an anti-adhesive agent, a thixotropic agent, filler, a plasticizer, a nonreactive polymer, a colorant, a flame retardant, a flame retardant assistant, an anti-softening agent, a mold release agent, a desiccating agent, a dispersing agent, a moistening agent, a suspension stabilizer, a thickening agent, an antistatic agent, a destaticizing agent, a mildew proofing agent, a rodent repellent, an ant repellent, a flatting agent, an anti-blocking agent, an anti-skinning agent, a surfactant and the like.

The ultraviolet irradiation source in the embodiment includes a low-pressure mercury lamp, a metal halide lamp and the like.

The surfactant is roughly classified into an ionic surfactant that is ionized when dissolved in water so as to become ions (charged atoms or atomic groups) and a nonionic surfactant that does not become ions. The ionic surfactant is further classified into a negative ion (anionic) surfactant, a positive ion (cationic) surfactant and an ampholytic surfactant.

Of these, since high electrical insulation property is desired in the embodiment, the nonionic surfactant is preferable.

The nonionic surfactant is classified into an ester type, an ether type, an ester/ether type and the other types according to the structure. In the embodiment, it includes compounds described below, but it is not particularly limited.

The ester type surfactant includes glycerin fatty acid ester, sorbitan fatty acid ester and sucrose fatty acid ester.

The ether type surfactant includes an addition polymer obtained by that an addition polymerization of a material compound having hydroxyl groups such as higher alcohol, alkyl phenol or the like is carried out mainly in the presence of ethylene oxide.

The ester/ether type surfactant includes an addition polymer obtained by adding ethylene oxide to fatty acid or polyhydric alcohol fatty acid ester, that has both of ester bonds and ether bonds.

The other surfactants include a fluorochemical surfactant and a silicone based surfactant.

With regard to the surfactant, there is an index of hydrophile-lipophile balance (HLB) that represents degree of hydrophilicity and lipophilicity, and in case of the embodiment, it is essential to fabricate the W/O type emulsion in which water drops exist in oil, so that a surfactant having lower HLB is preferably used. The surfactant having the HLB of not more than 5 produces a great effect. Also, it is preferable that the surfactant usage is small and it is more preferable that the usage is not more than 1% because of insulating characteristics of wire cable.

Method of Fabricating Insulated Wire

A method of fabricating an insulated wire according to the embodiment includes the steps of coating a water-in-oil type emulsion (W/O emulsion) on a conductor so as to form a thin film as a coated film, curing the oil by ultraviolet irradiation after the formation of the thin film, and drying and removing the water drops as the water by heated air after the curing so as to obtain an insulated wire having an insulating layer of a porous member.

EXAMPLES

Hereinafter, a method of fabricating an insulated wire having an insulating layer of a porous member of the invention will be explained by Examples and Comparative Examples.

Example 1

Example 1-1

A composition containing components (1) to (4) described below was agitated at 10,000 RPM for 5 minutes by a high speed agitating machine (Excel Homogenizer ED-12: manufactured by Nihonseiki Kaisya Ltd.) and was left for 6 hours, and a water-in-oil type emulsion (W/O emulsion) having water drops of 3 μM in average particle diameter was prepared.

Figure 2:
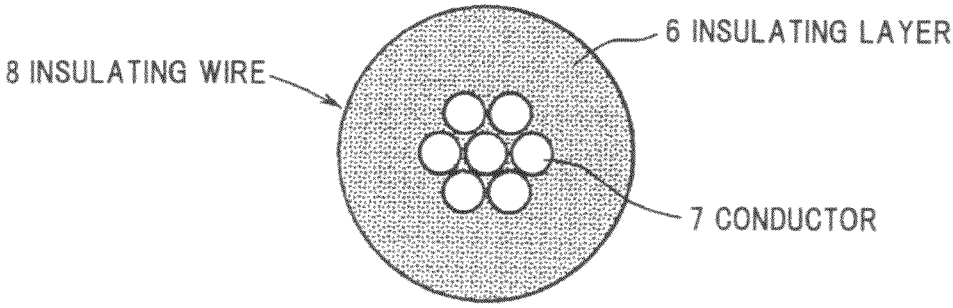
FIG. 2 is a cross-sectional view schematically showing an insulated wire having an insulating layer of a porous member according to one embodiment of the invention.

Components of Composition:

(1) Polymerizable oligomer: urethane acrylate oligomer 80.0 parts by mass (2) Polymerizable monomer: monomer having acryloyl groups 20.0 parts by mass (3) Cross-linking initiator: 1-hydroxy cyclohexyl-phenyl-ketone ("Irgacure" (which is a registered trademark) 184: manufactured by Ciba Specialty Chemicals) 2 parts by mass (4) Water-soluble polymer: methyl cellulose (2% by mass water solution of Metolose MCE-400: manufactured by Shin-Etsu Chemical Co., Ltd.) 60 parts by mass Next, by using the emulsion prepared according to the above mentioned process and a coating-curing-drying machine shown in FIG. 1 including a wire conductor feeding device 1, a coating die 2, an ultraviolet lamp 3 (metal halide lamp 1 kW), a drying device 4 (250 degrees C. heated air type, 1 second heating), and a wire winding device 5 (60 m/minute), an insulated wire 8 shown in FIG. 2 was fabricated.

The insulated wire 8 obtained has a conductor 7 formed of a stranded wire of seven copper wires of 25 μm in diameter and an insulating layer 6 of 40 μm in thickness. Air bubbles of 3 μm in average particle diameter have a volume corresponding to 35% of the total volume of the insulating layer 6 obtained.

Example 1-2

In order to check preservation stability of the water-in-oil type emulsion (W/O emulsion), after the preparation of the emulsion in Example 1-1, it was left for 24 hours, and when the average particle diameter of the air bubbles was measured, it was recognized as 3 μm, consequently, it can be said that the air bubbles maintain the same average particle diameter as that just after the preparation of the emulsion.

By using the emulsion and the coating-curing-drying machine shown in FIG. 1 including a wire conductor feeding device 1, a coating die 2, an ultraviolet lamp 3 (metal halide lamp 1 kW), a drying device 4 (250 degrees C. heated air type, 1 second heating), and a wire winding device 5 (60 m/minute), an insulated wire 8 was similarly fabricated.

The insulated wire 8 obtained has a conductor 7 formed of a stranded wire of seven copper wires of 25 μm in diameter and an insulating layer 6 of 40 μm in thickness. Air bubbles of 3 μm in average particle diameter have a volume corresponding to 35% of the total volume of the insulating layer 6 obtained. Consequently, it can be said that the insulated wires of Example 1-1 left for 6 hours and Example 1-2 left for 24 hours have almost the same characteristics.

Example 2

Example 2-1

A composition containing components (1) to (4) described below was agitated at 10,000 RPM for 5 minutes by a high speed agitating machine (Excel Homogenizer ED-12: manufactured by Nihonseiki Kaisya Ltd.) and was left for 6 hours, and a water-in-oil type emulsion (W/O emulsion) having water drops of 12 μm in average particle diameter was prepared.

Components of Composition:

(1) Polymerizable oligomer: urethane acrylate oligomer 80.0 parts by mass (2) Polymerizable monomer: monomer having acryloyl groups 20.0 parts by mass (3) Cross-linking initiator: 1-hydroxy cyclohexyl-phenyl-ketone ("Irgacure" (which is the registered trademark) 184: manufactured by Ciba Specialty Chemicals) 2 parts by mass (4) Water-soluble polymer: methyl cellulose (2% by mass water solution of Metolose MCE-400: manufactured by Shin-Etsu Chemical Co., Ltd.) 40 parts by mass Next, by using the emulsion prepared according to the above mentioned process and a coating-curing-drying machine shown in FIG. 1 including a wire conductor feeding device 1, a coating die 2, an ultraviolet lamp 3 (metal halide lamp 1 kW), a drying device 4 (250 degrees C. heated air type, 1 second heating), and a wire winding device 5 (60 m/minute), an insulated wire 8 was fabricated.

The insulated wire 8 obtained has a conductor 7 formed of a stranded wire of seven copper wires of 25 μm in diameter and an insulating layer 6 of 40 μm in thickness. Air bubbles of 3 μm in average particle diameter have a volume corresponding to 25% of the total volume of the insulating layer 6 obtained.

Example 2-2

In order to check preservation stability of the water-in-oil type emulsion (W/O emulsion), after the preparation of the emulsion in Example 2-1, it was left for 24 hours, and when the average particle diameter of the air bubbles was measured, it was recognized as 12 μm, consequently, it can be said that the air bubbles maintain the same average particle diameter as that just after the preparation of the emulsion.

By using the emulsion and the coating-curing-drying machine shown in FIG. 1 including a wire conductor feeding device 1, a coating die 2, an ultraviolet lamp 3 (metal halide lamp 1 kW), a drying device 4 (250 degrees C. heated air type, 1 second heating), and a wire winding device 5 (60 m/minute), an insulated wire 8 was similarly fabricated.

The insulated wire 8 obtained has a conductor 7 formed of a stranded wire of seven copper wires of 25 μm in diameter and an insulating layer 6 of 40 μm in thickness. Air bubbles of 3 μm in average particle diameter have a volume corresponding to 25% of the total volume of the insulating layer 6 obtained. Consequently, it can be said that the insulated wires of Example 2-1 left for 6 hours and Example 2-2 left for 24 hours have almost the same characteristics.

Comparative Example 1

A varnish including a composition containing components (1) to (3) described below was prepared.

Components of Composition:

(1) Polymerizable oligomer: urethane acrylate oligomer 80.0 parts by mass (2) Polymerizable monomer: monomer having acryloyl groups 20.0 parts by mass (3) Cross-linking initiator: 1-hydroxy cyclohexyl-phenyl-ketone ("Irgacure" (which is the registered trademark) 184: manufactured by Ciba Specialty Chemicals) 2 parts by mass Next, by using the emulsion prepared according to the above mentioned process and a coating-curing-drying machine shown in FIG. 1 including a wire conductor feeding device 1, a coating die 2, an ultraviolet lamp 3 (metal halide lamp 1 kW), a drying device 4 (250 degrees C. heated air type, 1 second heating), and a wire winding device 5 (60 m/minute), an insulated wire was fabricated.

The insulated wire obtained has a conductor formed of a stranded wire of seven copper wires of 25 μm in diameter and an insulating layer of 40 μm in thickness. No air bubble could be seen in the insulating layer obtained.

Comparative Example 2

Comparative Example 2-1

A composition containing components (1) to (4) described below was agitated at 10,000 RPM for 5 minutes by a high speed agitating machine (Excel Homogenizer ED-12: manufactured by Nihonseiki Kaisya Ltd.) and was left for 6 hours, and a water-in-oil type emulsion (W/O emulsion) having water drops of 10 μm in average particle diameter was prepared.

Components of Composition:

(1) Polymerizable oligomer: urethane acrylate oligomer 80.0 parts by mass (2) Polymerizable monomer: monomer having acryloyl groups 20.0 parts by mass (3) Cross-linking initiator: 1-hydroxy cyclohexyl-phenyl-ketone ("Irgacure" (which is the registered trademark) 184: manufactured by Ciba Specialty Chemicals) 2 parts by mass (4) Water 60 parts by mass Next, by using the emulsion prepared according to the above mentioned process and a coating-curing-drying machine shown in FIG. 1 including a wire conductor feeding device 1, a coating die 2, an ultraviolet lamp 3 (metal halide lamp 1 kW), a drying device 4 (250 degrees C. heated air type, 1 second heating), and a wire winding device 5 (60 m/minute), an insulated wire was fabricated. The insulated wire obtained has a conductor formed of a stranded wire of seven copper wires of 25 μm in diameter and an insulating layer of 40 μm in thickness.

Air bubbles of 12 μm in average particle diameter have a volume corresponding to 35% of the total volume of the insulating layer obtained.

Comparative Example 2-2

In order to check preservation stability of the water-in-oil type emulsion (W/O emulsion), after the preparation of the emulsion in Comparative Example 2-1, it was left for 24 hours, and when the average particle diameter of the air bubbles was measured, it was recognized as 20 μm, consequently, it can be said that the average particle diameter of the air bubbles was extremely grown due to association of the particles in comparison with the case of Comparative Example 2-1 left for 6 hours after the preparation.

By using the emulsion and the coating-curing-drying machine shown in FIG. 1 including a wire conductor feeding device 1, a coating die 2, an ultraviolet lamp 3 (metal halide lamp 1 kW), a drying device 4 (250 degrees C. heated air type, 1 second heating), and a wire winding device 5 (60 m/minute), an insulated wire was similarly fabricated.

The insulated wire obtained has a conductor formed of a stranded wire of seven copper wires of 25 μm in diameter and an insulating layer of 40 μm in thickness. Air bubbles of 20 μm in average particle diameter have a volume corresponding to 35% of the total volume of the insulating layer obtained, and a problem was caused that parts of the insulating layer were exposed. As described above, in the Comparative Example 2-2, the average particle diameter of water drops in the emulsion changes in a day after the preparation of the emulsion, consequently, it can be seen that in the Comparative Example, a stable emulsion can not be obtained.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. An insulated wire, comprising:

a conductor; and an insulating layer of a porous member formed on the conductor by using a water-in-oil type emulsion (W/O emulsion) comprising a thermosetting liquid solventless varnish as the oil and water drops of water-soluble polymer contained in the thermosetting liquid solventless varnish as the water, the thermosetting liquid solventless varnish as the oil consisting of a polymerizable oligomer comprising an urethane acrylate oligomer, a polymerizable monomer comprising a monomer having not less than two of an acryloyl group and a cross-linking initiator comprising a ketal compound, the water-soluble polymer consisting of one selected from hydroxymethylcellulose, hydroxyethylcellulose, and hydroxypropylcellulose, wherein the insulating layer of the porous member is formed by that the water-in-oil type emulsion is coated so as to form a thin film as a coated film, the thermosetting liquid solventless varnish as the oil is polymerized and cured after the formation of the thin film, and the water drops as the water is dried and removed after the curing of the thermosetting liquid solventless varnish.

2. The insulated wire according to claim 1, wherein the thermosetting liquid solventless varnish as the oil comprises an ultraviolet cure resin precursor, and the precursor is polymerized and cured by ultraviolet irradiation.

* * * * *